United States Patent [19]

Van Vliet et al.

[11] Patent Number: 4,978,884

[45] Date of Patent: Dec. 18, 1990

[54] METAL HALIDE DISCHARGE LAMP HAVING LOW COLOR TEMPERATURE AND IMPROVED COLOR RENDITION

[75] Inventors: Johannes A. J. M. Van Vliet; Hendrik A. Van Esveld, both of Eindhoven, Netherlands

[73] Assignee: U.S. Phillips Corporation

[21] Appl. No.: 337,023

[22] Filed: Apr. 12, 1989

[30] Foreign Application Priority Data

May 19, 1988 [NL] Netherlands ..... 8801290

[51] Int. Cl.[5] ..... H01J 61/20; H01J 61/34

[52] U.S. Cl. ..... 313/25; 313/641

[58] Field of Search ..... 313/25, 640, 641

[56] References Cited

U.S. PATENT DOCUMENTS

| | | | |
|---|---|---|---|
| 3,452,238 | 6/1969 | Larson | 313/641 |
| 3,842,307 | 10/1974 | Dobrusskin et al. | 313/640 X |
| 4,808,876 | 2/1989 | French et al. | 313/640 X |
| 4,866,342 | 9/1989 | Ramaiah et al. | 313/640 X |

*Primary Examiner*—Kenneth Wieder

[57] ABSTRACT

The high-pressure discharge lamp has an ionizable filling containing mercury, rare gas, dysprosium halide and a second halide chosen from the halides of Tl, Ce, Pr, Nd, Sm and Gd. The lamp has a comparatively low color temperature and a good color rendition, especially also of the color of the skin. The lamp may be used, for example, as a studio lamp for the illumination of indoor scenes.

6 Claims, 3 Drawing Sheets

METAL HALIDE DISCHARGE LAMP HAVING LOW COLOR TEMPERATURE AND IMPROVED COLOR RENDITION

BACKGROUND OF THE INVENTION

The invention relates to a high-pressure metal halide discharge lamp comprising a translucent discharge vessel sealed in a vacuum-tight manner and arranged in a translucent outer envelope, which is sealed in a vacuum-tight manner and through whose walls current supply conductors extend to electrodes arranged in the discharge vessel, an ionizable filling in the discharge vessel containing mercury, rare gas, dysprosium halide and a second metal halide selected from a group to which thallium iodide belongs.

Such a lamp is known from British patent specification No. 1,138,913.

The lamp known from this British patent specification comprises as a second metal halide thallium iodide.

The known lamp has the attractive property that the gas filling is of a simple composition and that the lamp offers a good colour rendition. The lamp is therefore suitable for illumination of offices and shops, but also for road illumination. A disadvantage of the said known lamp, like of many other known metal halide lamps, is that its colour temperature is fairly high. The light emitted by the lamp is therefore designated as "cool white".

SUMMARY OF THE INVENTION

The invention has for its object to provide a lamp of the kind described in the opening paragraph, which is suitable inter alia to be used as a studio lamp for the illumination of indoor scenes and as spotlight, for example in shop-windows. For this purpose, the invention has for its object to provide such a lamp which has comparatively low colour temperature and a good colour rendition, especially also of the colour of the skin, while nevertheless the composition of the gas filling is simple.

In the lamp according to the invention, this object is achieved in that the ionizable filling contains a second metal halide selected from the group consisting of halides of Tl, Ce, Pr, Nd, Sm and Gd, the metal mass of the dysprosium halide is approximately 1.5 to approximately 8 mg per ml of volume of the discharge vessel and is at least approximately 10% of the metal mass of mercury, and the quantity of the second metal halide is 0 to 0.015 mmol/ml of volume of the discharge vessel.

The ionizable filling may also contain substantially solely caesium halide in a quantity of 0 mmol to a quantity equimolar with dysprosium halide and 0 to 0.01 mmol/ml of mercury halide.

The lamp according to the invention has a very high colour rendition index ($Ra_8$), in general higher than 90, and a high value of $R_9$, i.e. the index indicating the rendition of the colour of the skin, generally higher than 80. The lamp has a quasi continuous spectrum which practically coincides with the emission curve of a black body radiator of the same colour temperature between approximately 3000 and approximately 4000K. This is due on the one hand to the comparatively large quantity of dysprosium in the ionizable filling and on the other hand to the second metal halide which is used to yield the colour point of the emitted light in the C.I.E. colour diagram in the immediate proximity of the black body locus if the colour point in the absence of said halide is removed from this line. Without the second metal halide, the y coordinate of the colour point of light having a colour temperature above 3000K is in fact too low.

Essentially larger quantities of dysprosium have hardly any effect on the colour temperature; with essentially smaller quantities, the colour temperature of the lamp is too high. The dysprosium/mercury ratio in the filling is also of importance in connection with the quantity of dysprosium. With essentially lower ratios, the colour temperature is too high. The quantity of mercury in the filling and hence the admissible ratio Dy/Hg is of importance for the operating voltage of the lamp. With the use of an electronic ballast unit, the operating voltage can be considerably lower than the 50% of the mains voltage usual with the use of a choke coil and a smaller quantity of mercury can be used than with the use of a choke coil.

Caesium halide may, but need not be, present. This substance renders the discharge arc of the lamp more diffuse and less contracted than in the absence of the substance. With quantities of caesium halide which are considerably higher than the quantity equimolar with dysprosium halide, the efficiency of the lamp is considerably lower. For the properties of the lamp it is not important in which form the elements present in the lamp are introduced, either as halides or in elementary form. If, for example, dysprosium is dosed as metal, halogen may be introduced as mercury halide. During operation of the lamp, mercury and dysprosium halide are then formed. If a complete conversion of dysprosium is desirable, mercury halide may be dosed in excess quantity. However, too large an excess may increase excessively the reignition voltage of the lamp.

The halides may be iodides, but it is possible to use mixtures of, for example, iodides and bromides. In order to maintain the light output of the lamp for a period of thousands of hours, it is favourable if the ration mol Br/mol I in the filling lies between 1.5 and 4.

BRIEF DESCRIPTION OF THE DRAWINGS

An embodiment of the lamp according to the invention is shown in the drawings. In the drawings.

DESCRIPTION OF THE PREFERRED EMBODIMENTS

Figure 1:
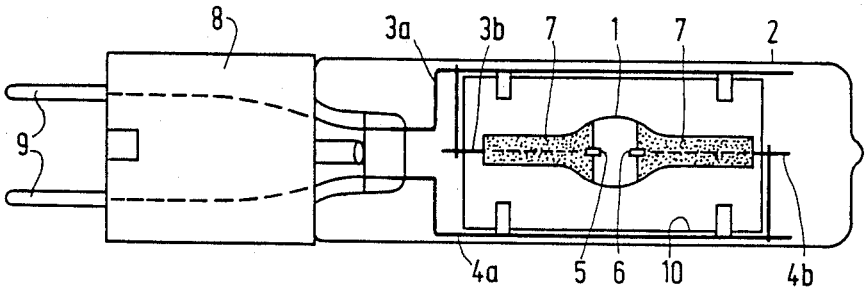
FIG. 1 is a side elevation of a lamp.
Figure 2:
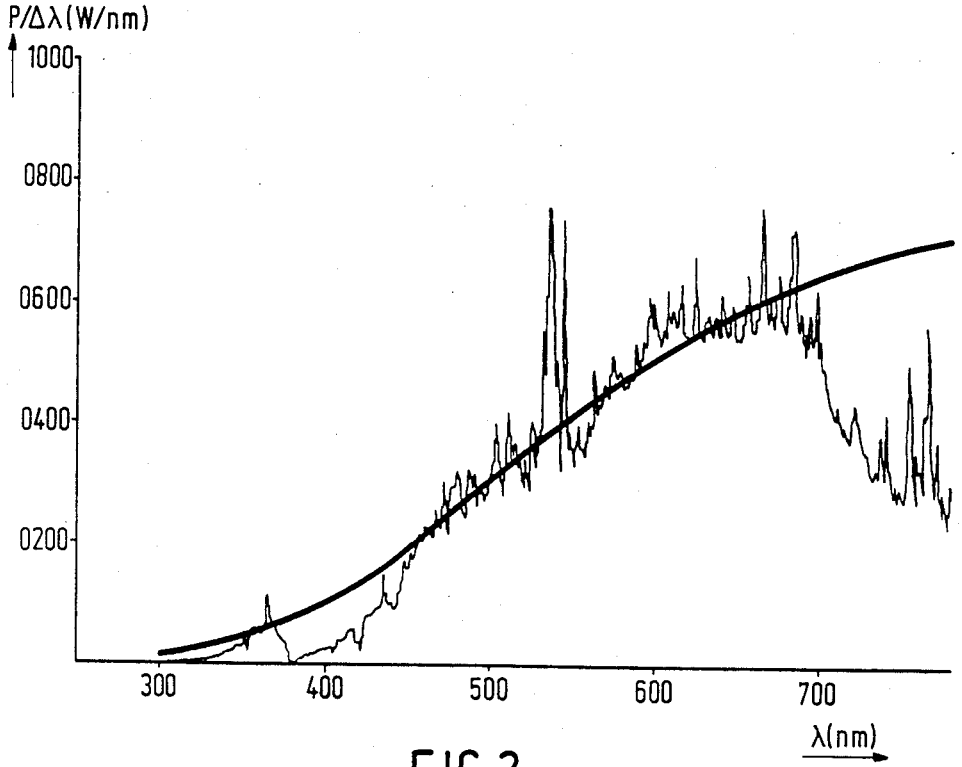
FIG. 2 to FIG. 6 each show the spectrum of an embodiment.
Figure 3:
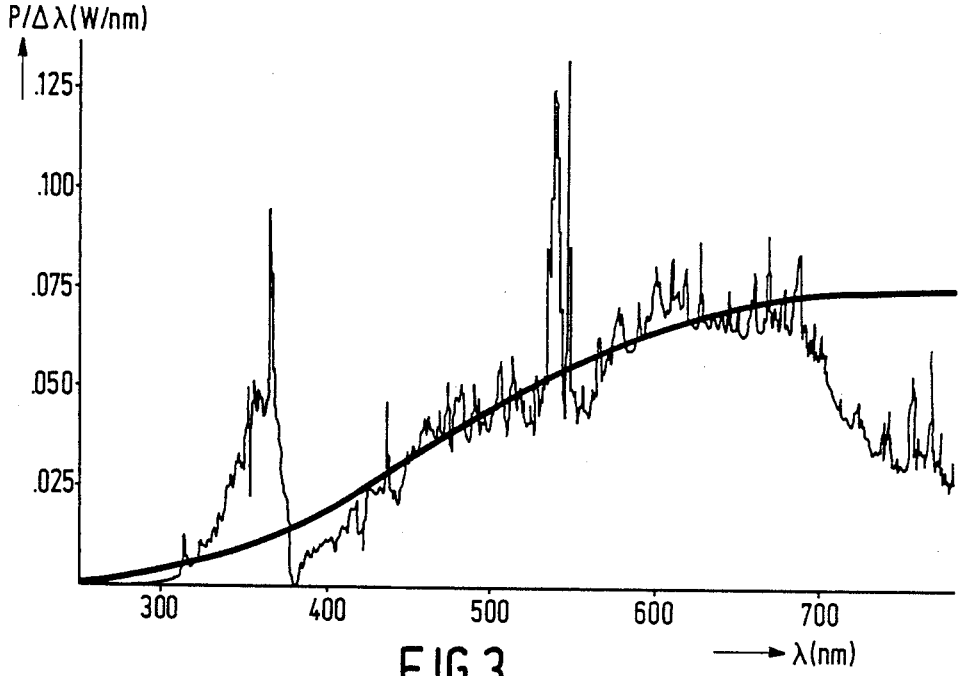
Figure 4:
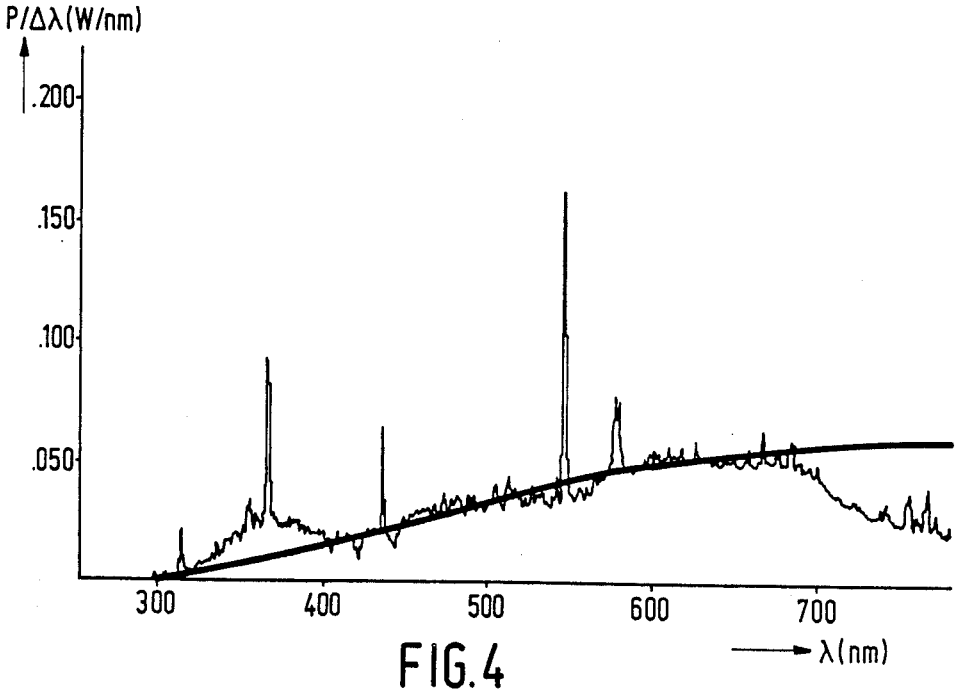
Figure 5:
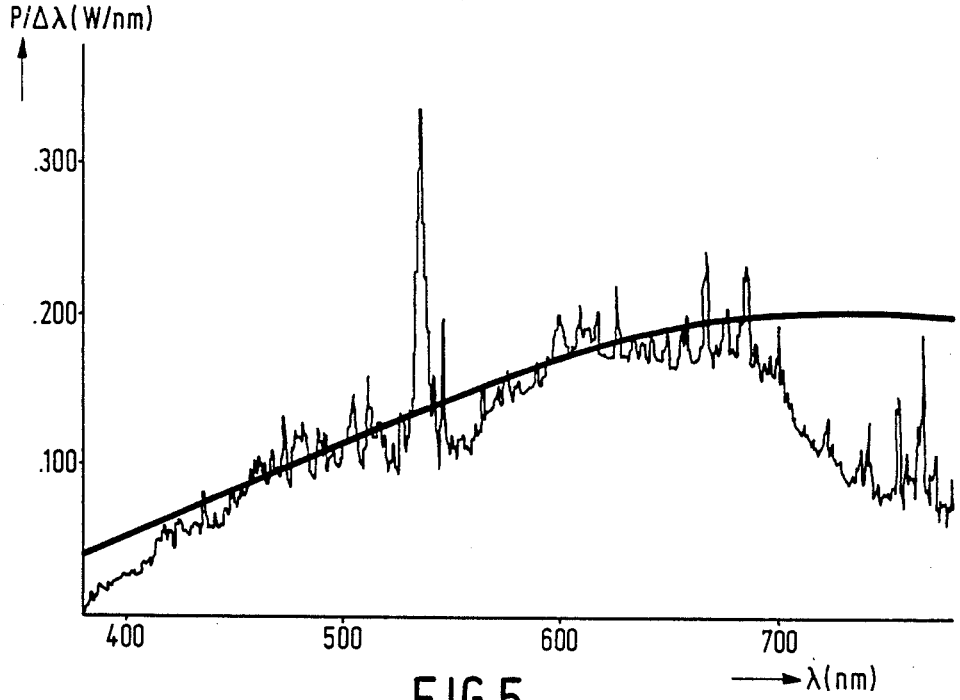
Figure 6:
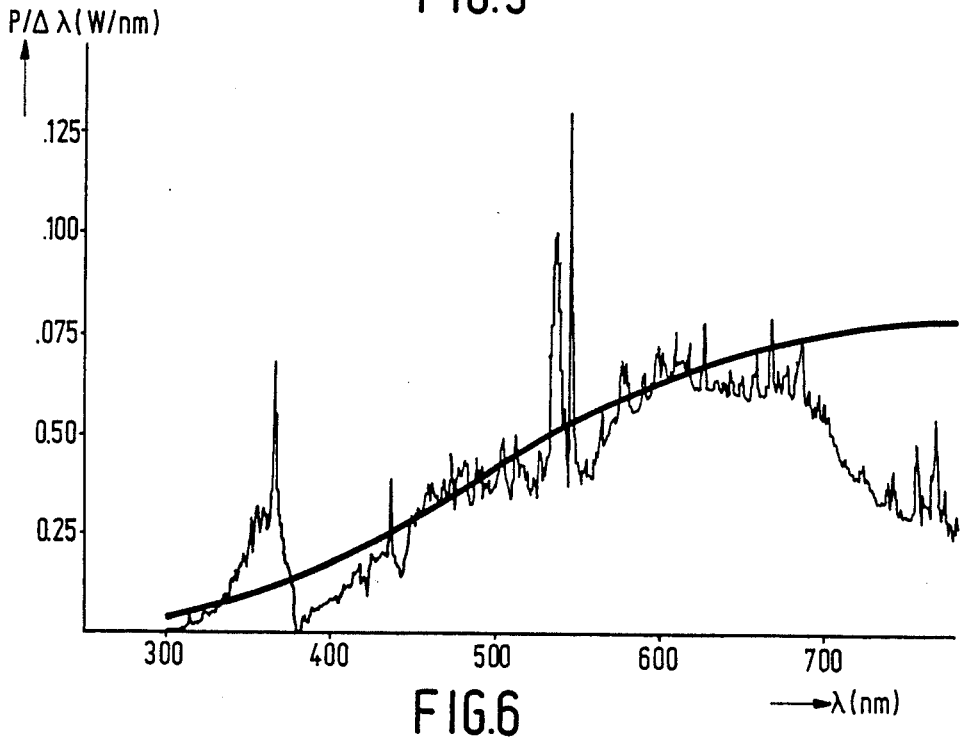

In FIG. 1, the high-pressure metal halide discharge lamp has a translucent discharge vessel 1 of quartz glass, which is sealed in a vacuum-tight manner and is arranged in a translucent outer envelope 2 of glass, which is sealed in a vacuum-tight manner. Current supply conductors 3*a*, 3*b* and 4*a*, 4*b* extend through the walls of the discharge vessel 1 and of the outer envelope 2, respectively, to electrodes 5, 6 arranged in the discharge vessel.

The discharge vessel 1 has an ionizable filling containing mercury, rare gas, dysprosium halide and a second metal halide selected from a group to which thallium iodide belongs.

The ionizable filling according to the invention contains a second metal halide selected from the group consisting of halides of Tl, Ce, Pr, Nd, Sm and Gd, solely caesium halide in a quantity of 0 mmol to a quantity equimolar with dysprosium halide and 0 to 0.03 mmol/ml of mercury halide, the metal mass of the dysprosium halide is approximately 1.5 to approximately 8 mg per ml of volume of the discharge vessel and is at least approximately 10% of the metal mass of mercury, and the quantity of the second metal halide is 0 to 0.015 mmol/ml of volume of the discharge vessel.

The ionizable filling also contains substantially solely caesium halide in a quantity of 0 mmol to a quantity equimolar with dysprosium halide and 0 to 0.3 mmol/ml of mercury halide.

The lamp shown in FIG. 1 has a lamp cap 8 with contacts 9 each connected to one of the current supply conductors 3*a*, 4*a*. In the outer envelope is arranged a glass sleeve 10 surrounding the discharge vessel 1. The outer envelope 2 is evacuated. Especially with lamps having a colour temperature in the lower part of the range between approximately 3000 and 4000K and with lamps having a comparatively low power of, for example, 100 W or lower, the glass sleeve is effective as means for limiting heat losses.

A heat-trapping envelope 7 on the discharge vessel 1 surrounds the current supply conductors 3*b*, 4*b*. In the Figure, the envelope 7 consists of a layer of $ZrO_2$ limiting heat emission through the non-light-emitting part of the discharge vessel.

Embodiments of lamps having the configuration of FIG. 1 are indicated with their properties in Table 1.

TABLE 1

| | | 1 | 2 | 3 | 4 | 5 |
|---|---|---|---|---|---|---|
| DyI3 | (mg) | 4.5 | 3.0 | 4.5 | 7.8 | 0 |
| DyBr3 | (mg) | 0 | 0 | 0 | 0 | 3.3 |
| Hg | (mg) | 8.0 | 8.0 | 6.8 | 5.3 | 6.8 |
| TlI | (mg) | 0.75 | 0.75 | 0 | 2.2 | 0.45 |
| CeI3 | (mg) | 0 | 0 | 0.71 | 0 | 0 |
| CsI | (mg) | 0.35 | 0 | 0 | 0.3 | 0 |
| Vol | (ml) | 0.35 | 0.35 | 0.35 | 1 | 0.35 |
| Dy/Vol | (mg/ml) | 3.86 | 2.57 | 3.86 | 2.33 | 3.86 |
| Dy/Hg | (mg/mg %) | 17 | 11 | 31 | 44 | 31 |
| TlI | (mmol/ml) | 0.007 | 0.007 | 0 | 0.007 | 0.004 |
| CeI3 | (mmol/ml) | 0 | 0 | 0.007 | 0 | 0 |
| Tc | (K) | 3344 | 3815 | 3730 | 3699 | 3644 |
| Ra8 | | 96 | 97 | 95 | 97 | 97 |
| R9 | | 87 | 81 | 80 | 98 | 80 |
| P | (W) | 70 | 70 | 70 | 150 | 70 |
| η | (lm/W) | 47 | 63 | 48 | 72 | 57 |

The lamps all contain 200 mbar of Ar.

FIGS. 2 to 6 show the emission spectrum of the examples 1, 2, 3, 4 and 5, respectively, of Table 1. In these Figures, the absolute spectral power is plotted against the wavelength of the generated radiation. The smooth line in these Figures is the emission spectrum of a black body radiator of the same colour temperature. It appears from these Figures that the lamp according to the invention has a quasi continuous spectrum which practically coincides with the emission curve of a black body radiator.

The high colour rendition index and the high value of the index for the rendition of the colour of the skin appear from the Table.

What is claimed is:

1. A high-pressure metal halide discharge lamp comprising a sealed outer envelope, a translucent discharge vessel within said outer envelope sealed in a gas-tight manner and having discharge electrodes arranged therein, current conductors extending through said outer envelope to said electrodes, and an ionizable filling in the discharge vessel comprising mercury, a rare gas, dysprosium halide and a second metal halide, characterized in that:

said second metal halide is selected from the group consisting of halides of T1, Ce, Pr, Nd, Sm and Gd, the metal mass of the dysprosium halide is approximately 1.5 to approximately 8 mg per ml of volume of the discharge vessel and is at least approximately 10% of the metal mass of mercury, and the quantity of said second metal halide is 0 to 0.015 mmol/ml of volume of the discharge vessel.

2. A high-pressure metal halide discharge lamp as claimed in claim 1, wherein said ionizable filling further comprises caesium halide in a quantity greater than 0 mmol to a quantity equimolar with dysprosium halide.

3. A high-pressure metal halide discharge lamp as claimed in claim 2, wherein said ionizable filling comprises a quantity of mercury halide less than or equal to 0.01 mmol/ml.

4. A high-pressure method halide discharge lamp as claimed in claim 3, wherein said first and second metal halides consist of a mixture of halides and bromides and the ratio mol Br/mol I is in the range $1.5 \leqq$ mol Br/mol I $\leqq 4$.

5. A high-pressure method halide discharge lamp as claimed in claim 2, wherein said first and second metal halides consist of a mixture of halides and bromides and the ratio mol Br/mol I is in the range $1.5 \leqq$ mol Br/mol I $\leqq 4$.

6. A high-pressure method halide discharge lamp as claimed in claim 1, wherein said first and second metal halides consist of a mixture of halides and bromides and the ratio mol Br/mol I is in the range $1.5 \leqq$ mol Br/mol I $\leqq 4$.

* * * * *